US007097386B2

(12) United States Patent
Maduell et al.

(10) Patent No.: US 7,097,386 B2
(45) Date of Patent: Aug. 29, 2006

(54) SIMULTANEOUS DEVELOPMENT OF UNDERGROUND CAVERNS AND DEPOSITION OF MATERIALS

(75) Inventors: Roger Jacques Maduell, Amite, LA (US); David Charles Landry, Madisonville, LA (US); David Brian Singleton, New Orleans, LA (US)

(73) Assignee: Freeport-McMoran Energy LLC, New Orleans, LA (US)

( * ) Notice: Subject to any disclaimer, the term of this patent is extended or adjusted under 35 U.S.C. 154(b) by 0 days.

(21) Appl. No.: 10/953,784

(22) Filed: Sep. 29, 2004

(65) Prior Publication Data

US 2005/0105971 A1 May 19, 2005

Related U.S. Application Data

(60) Provisional application No. 60/519,256, filed on Nov. 13, 2003.

(51) Int. Cl.
*B09B 1/00* (2006.01)

(52) U.S. Cl. ..... 405/129.35; 405/58; 299/3; 588/250

(58) Field of Classification Search ..... 405/129.35, 405/58; 299/3, 5; 588/250
See application file for complete search history.

(56) References Cited

U.S. PATENT DOCUMENTS 3,768,865 A 10/1973 Dehn
4,192,555 A 3/1980 Willett
4,249,833 A * 2/1981 Talley ..... 299/5
4,435,290 A 3/1984 Lindorfer et al.
4,488,834 A 12/1984 Hooper et al.
4,576,513 A 3/1986 Lindorfer et al.
4,577,999 A 3/1986 Lindorfer et al.
4,596,490 A 6/1986 Van Fossan et al.
4,886,393 A 12/1989 Jahn-Held et al.
4,906,135 A * 3/1990 Brassow et al. ..... 405/129.35
5,238,664 A * 8/1993 Frint et al. ..... 299/5
5,310,282 A * 5/1994 Voskamp ..... 405/128.25
5,431,482 A 7/1995 Russo
5,589,603 A 12/1996 Alexander et al.
5,669,734 A 9/1997 Becnel, Jr. et al.
5,734,988 A 3/1998 Alexander et al.
5,863,283 A 1/1999 Gardes
6,002,063 A 12/1999 Bilak et al.
6,022,080 A 2/2000 Gruschow et al.
6,137,028 A * 10/2000 Snow ..... 588/250

* cited by examiner

*Primary Examiner*—John Kreck
(74) *Attorney, Agent, or Firm*—Jones, Walker, Waechter, Poitevent, Carrere & Denegre, L.L.P.

(57) ABSTRACT

A method is provided for simultaneously developing caverns while depositing wastes or other materials in them. A well is first drilled into a salt formation and the development of a salt cavern by means of solution mining is initiated. When the development of the cavern has been carried out to an extent sufficient to accommodate the injection of a prescribed amount of wastes or other materials, injection of the wastes or other materials through the well is started while continuing to develop the cavern by solution mining. The injection of the wastes or other materials may be carried out continuously or intermittently. The proportion and rates of wastes or other materials and mining water injected into the well are monitored and regulated so that cavern development continues at a rate that allows the cavern to reach an intended prescribed size while the wastes or other materials are injected and deposited into the cavern.

55 Claims, 3 Drawing Sheets

SIMULTANEOUS DEVELOPMENT OF UNDERGROUND CAVERNS AND DEPOSITION OF MATERIALS

This application is a non-provisional application for patent entitled to a filing date and claiming the benefit of earlier-filed Provisional Application for Patent No. 60/519,256, filed on Nov. 13, 2003 under 37 CFR 1.53 (c).

FIELD OF THE INVENTION

This invention relates to a method for the deposition of materials and the disposal of wastes. Particularly, this invention relates to a method for the disposal of wastes generated in the natural resource mining industry. More particularly, the invention relates to a method for the deposition of materials and the disposal of wastes in underground reservoirs. Specifically, the invention relates to a novel technique for creating and providing underground caverns by means of solution mining techniques while simultaneously disposing of wastes in said underground caverns.

BACKGROUND OF THE INVENTION

The constant increase in waste generation worldwide is accompanied by an increasing need to provide for proper waste disposal. In the natural resource mining industry this trend is exemplified by the need to find and provide practicable and efficient technologies for the proper disposal of oil field and other such solid and liquid wastes that are not only cost-effective, but also environmentally sound. Such technologies often involve special methods and equipment for injecting and disposing of the waste in underground reservoirs such as subterranean cavities and salt caverns. Hence, technologies exist for the disposal of various types of wastes in underground reservoirs, and many techniques have been developed for creating and providing caverns in subterranean formations. Thus, for example, U.S. Pat. No. 4,435,290, of Lindörfer et al., discloses a process for the temporary storage and treatment of certain liquid wastes in an underground salt cavern, whereby acidic wastes are pumped underground and neutralized, then allowed to stand to separate their components by gravity. Part of the overlying light phase (such as an oil phase) is subsequently pumped out and the underlying aqueous heavy phase treated to precipitate the heavy metals, the heavy-metal-free overlying salt solution is then pumped out and the process steps repeated as necessary. The volume of the cavern can be maintained by pumping out the corresponding amount of salt solution. The excess salt solution may be discharged into the sea or put back into the caverns. In U.S. Pat. No. 4,577,999, Lindörfer et al., improve this technique by chemically treating liquid waste above ground to make it more "pumpable".

U.S. Pat. No. 4,488,834, of Hooper et al., claims a method for creating a special type of underground storage from a salt deposit by solution mining. The method consists in drilling a first well into the salt deposit and circulating raw water through it, then evacuating the water and injecting the material to be stored (which includes waste material) into the mined cavity, then sealing the cavity. A second well is then drilled on top of the first well and raw water again circulated and evacuated from the thus formed cavity, which is subsequently injected with the waste material and plugged. Means are provided to withdraw the injected material from storage. Multiple stacked storage cavities can be created in this fashion in which the first cavity may be a relatively small cavity that is easy to create and (if desired) larger storage cavities may be made thereafter from the same well on an as-needed basis.

U.S. Pat. No. 4,576,513, of Lindörfer et al., discloses a process for the terminal storage and treatment of certain liquid wastes in underground salt caverns. This is a companion patent to U.S. Pat. No. 4,435,290, in which the specific gravity of the waste liquid phase is increased by the addition of certain magnesium salts so as to convert the liquid phase into a paste-like consistency and thereby minimize convergence (volume contraction) of the salt caverns. Adsorbents (vermiculites, perlites and the like) are also used to increase the specific gravity. The idea is to narrow the difference between the specific gravity of the salt mineral of the cavern walls and the specific gravity of the liquid waste contained within the walls. Narrowing this difference eliminates or minimizes the undesirable convergence. The caverns are sealed after substantial solidification of the wastes has taken place.

U.S. Pat. No. 4,596,490, of Van Fossan et al., teaches a method of making underground storage chambers within salt formations by solution mining techniques in order to store brine- or water-soluble fluid materials, such as caustic soda, anhydrous ammonia and ethylene dichloride. U.S. Pat. No. 4,692,061, of Lindörfer et al., addresses the disposal of particulate solid waste materials in an underground salt-enclosed cavity that contains rock salt solution. The novelty of the method revolves around the treatment of the solid waste materials with a dust suppressant and solidifying the water that may be present in the dust suppressant. Other chemicals are added to the injected materials in order to best convert them to a "pumpable" state. U.S. Pat. No. 4,906,135, of Brassow et al., claims an elaborate method and apparatus for the disposal of hazardous wastes in salt domes whereby the wastes are first transferred to a "chemical solidification unit" to be solidified, then sent down to a salt cavern by means of injection tubes under controlled conditions; while U.S. Pat. No. 4,886,393, of Jahn-Held et al., addresses ways of pretreating a solid waste so that it may be injected by gravity into underground salt caverns via a down pipe.

U.S. Pat. No. 5,310,282, of Voskamp, discloses a method for the recovery of hydrocarbons from hydrocarbon-contaminated drilling muds that are stored in salt cavities. Brine is displaced from the cavities by the contaminated drilling muds that, after being injected, separate into a relatively dense component that gravitates to the bottom and a relatively light hydrocarbon component that rises through the brine and accumulates at the top of the cavity. The preferred cavities are located in anhydride formations that cause the solution-mined caverns to exhibit natural baffle-like anhydride ledges that provide a tortuous flow path thereby facilitating the separation of the hydrocarbons.

U.S. Pat. Nos. 5,589,603 and 5,734,988, both of Alexander et al., cover systems for the injection disposal of oil field waste in naturally occurring subterranean formations, whereby the formations are penetrated with a borehole, a slurry of solid material is then made at the surface of the earth and sent into the formation through the borehole while reducing the slurry pressure at the surface so that the pressure of the slurry inside the formation is less than the formation fracture pressure. U.S. Pat. No. 5,669,734, of Becnel, Jr. et al., describes an improved process for creating large underground storage caverns in domal salt deposits found in certain areas, such as the northeastern part of the United States, where the normal temperature of the water used for solution mining is relatively low. The process involves clarifying and using warm brine, produced on-site by solution mining the salt deposit, as the heating medium in an indirect-heating heat exchanger in order to preheat fresh water from local reserves. The preheated water is further heated, injected and circulated under controlled conditions through one or more caverns to maximize heat recovery efficiencies. The heat-depleted brine can be injected into disposal wells or used in chemical plants that require brine.

U.S. Pat. No. 5,863,283, of Gardes, discloses a system for disposing of hazardous wastes in deep underground formations. A special borehole configuration and sealed liner are provided. U.S. Pat. No. 6,002,063, of Bilak et al., claims a method and the equipment for the subterranean deep injection disposal of solid waste, in slurried form, within rock formations. A cased injection well is employed to inject the pressurized slurry of the waste material in a carrier liquid under controlled conditions. Many operational parameters are stipulated, and criteria for selecting the geological formation are offered and discussed.

U.S. Pat. No. 6,137,028, of Snow, discloses a method for the disposal of certain radioactive oil field waste material in subterranean salt formations. The method entails the drilling of two interconnected wells into a salt formation and the subsequent injection of the waste material, in aqueous slurry form, into the first well, allowing the waste solids to be deposited at the bottom of said well, and then withdrawing the slurry water from the formation through the second well. In another embodiment, fresh water is injected into the first well while withdrawing the resulting brine from the second well so as to create a salt cavern. The waste material is then slurried with salt water and injected through the first well, in slurry form, into the salt cavern. The waste solids are subsequently allowed to be deposited at the bottom of said salt cavern, and the slurry salt water is then withdrawn from the formation through the second well.

While the technologies described in these patents serve to address a number of individual waste disposal situations, none of them addresses the dual task of developing and/or enlarging a salt cavern while simultaneously disposing of waste in the cavern so as to accelerate the overall process under conditions that minimize the capital investments and operating costs required to conduct these operations. A need exists to provide a safe and efficient method for developing and enlarging a salt cavern by solution mining techniques while simultaneously disposing of waste in the cavern under conditions that minimize the capital investments and operating costs required in carrying out such operations. The present invention is directed toward providing such a method.

It is an object of this invention to provide a method for the efficient deposition of materials and disposal of wastes in subterranean reservoirs. It is also an object of this invention to provide a method for the disposal of waste in subterranean formations under conditions that minimize the capital investments and operating costs required in carrying out such waste disposal operations. It is another object of this invention to provide a commercially efficient technique for the simultaneous creation of an underground salt cavern and disposal of waste generated in the natural resource mining industry. A further object of the invention is to provide a commercially efficient technique for enlarging and developing existing underground salt caverns while simultaneously disposing of oil field waste and other solid and liquid wastes in such existing underground salt caverns. A specific object of this invention is to provide a commercially efficient method for the development of new underground salt caverns and the enlargement and further development of existing underground salt caverns so that they may be effectively used for disposal of various kinds of solid and liquid wastes, which method is not only cost-effective but also environmentally sound. These and other objects of the present invention will become apparent from the description that follows.

SUMMARY OF THE INVENTION

The method of this invention centers around the innovative concept of depositing wastes or other materials in salt caverns while simultaneously creating the caverns by a solution mining technique carried out under controlled conditions. The method comprises drilling a well into a naturally occurring salt formation and initiating the development of a salt cavern by means of solution mining techniques so as to mine the formation of salt with water (seawater or fresh water). When the initial development of the salt cavern in this fashion has been carried out to an extent sufficient to accommodate the injection of a prescribed amount of such wastes or other materials into the cavern, injection of the wastes or other materials through the well is started while continuing to develop the cavern by solution mining techniques. The injection of the wastes or other materials may be carried out continuously (into the constant flow of solution mining water), or intermittently (at time intervals between successive injections of solution mining water). The proportion and rates of wastes or other materials and solution mining water injected into the well are monitored and regulated so that cavern development continues in a manner and at a rate that allows the cavern to reach an intended prescribed size while the wastes or other materials are injected and deposited into the cavern. A casing is provided with the well, and adjustable hanging pipe strings are positioned within the casing in order to allow the injection of additional amounts of wastes or other materials into the cavern and the timely removal of the brine that carries the dissolved salt out of the cavern without carrying over any substantial amounts of the deposited wastes or other materials. The method may also be used to enlarge an existing underground salt cavern and place it in condition for use in underground waste disposal while maintaining the further cavern development ahead of the waste disposal rate. If an existing underground salt cavern is initially large enough to accommodate limited amounts of waste, the method may be used also to enlarge and develop the cavern to accommodate increased amounts of waste while maintaining the cavern development ahead of the waste disposal rate. By simultaneously combining the solution mining development of the subterranean salt cavern with the injection of the waste into the cavern, the method of the instant invention is capable of accelerating the overall cavern development-waste disposal process and significantly reducing the capital expenditures and the operating costs associated with the process operations. The combination of two operations in one and the accelerated feature of the resulting process allow the operations to be conducted in a cost-effective manner and with minimal impact on the environment. While specifically addressing waste disposal, the method of the instant invention applies also to the depositing of many other materials in salt caverns while continuing the development of the caverns.

BRIEF DESCRIPTION OF THE DRAWINGS

A clear understanding of the key features of the invention summarized above may be had by reference to the appended drawings, which illustrate the method of the invention, although it will be understood that such drawings depict preferred embodiments of the invention and, therefore, are not to be construed as limiting its scope with regard to other embodiments which the invention intends and is capable of contemplating. Accordingly.

DETAILED DESCRIPTION OF THE INVENTION

Figure 1:
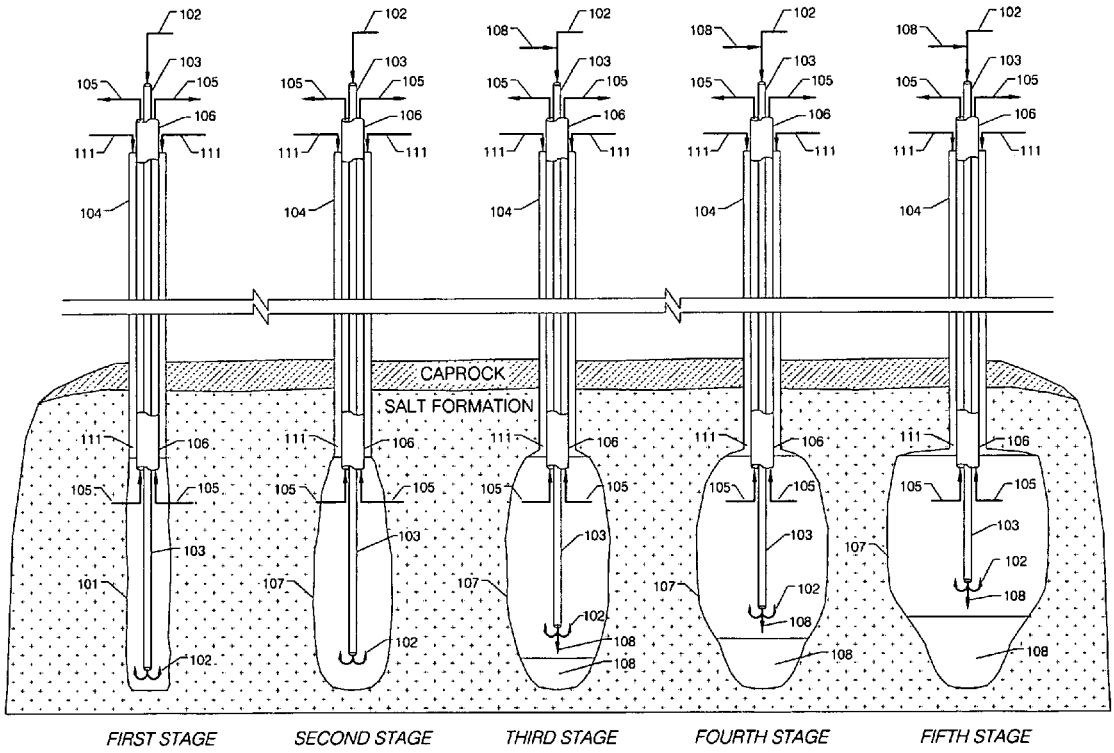
FIG. 1 is a schematic diagram of a preferred embodiment of this invention illustrating one manner in which a subterranean salt cavern may be developed and used while simultaneously disposing of a solid waste that is heavier than the fluid employed to carry out the solution mining (e.g., brine or water) in accordance with the method of the invention.

In FIG. 1 the method of this invention is illustrated in time sequence fashion with reference to the creation and development of a subterranean salt cavern and the simultaneous disposal of a heavier-than-brine solid waste. Referring to FIG. 1, a well 101 is first drilled into a naturally occurring salt formation located, typically, between about 500 and 3,000 feet below the surface of the earth. The initial drilling of the well is depicted in the First Stage diagram of FIG. 1, where well 101 is shown equipped with casing 104, which contains hanging mining pipe strings. Seawater 102 is injected through pipe 103, set inside casing 104 as part of the hanging pipe strings, and used to leach the salt in the salt formation. Pipe 103 is preferably made of steel, but it may also be made of other alloys, fiberglass or other materials. Since salt tends to dissolve in water up to 26% by weight, the leaching of the salt results in the extraction of brine 105, which exits through brine pipe 106, and contains anywhere between about 6 and 26% sodium chloride. (The normal salt content of seawater is about 3% sodium chloride.) Alternatively, fresh water, which has essentially no salt, may be used for the leaching instead of seawater. A cavern-roof-protecting blanket material 111, fed through casing 104, is placed and maintained in the top of the well. The positions of the hanging pipe strings in the well are made to be adjustable. As depicted in this First Stage diagram, the hanging pipe strings are initially positioned to allow the development of a vertically elongated salt cavern extending roughly from the area under the bottom of mine water pipe 103 to the area near the bottom of brine pipe 106. Such development is illustrated in the Second Stage diagram of FIG. 1, where salt cavern 107 begins to be formed by the leaching action of water 102, injected through mine water pipe 103, inside casing 104. At this point, brine 105 continues to be returned through brine pipe 106 and properly disposed of. The exiting brine may be injected into subterranean formations or disposed of at sea. The cavern-roof-protecting blanket material 111, fed through casing 104, is maintained in the top portion of the cavern in order to eliminate or minimize leakages. Nitrogen and certain other gases, mineral oil, diesel and similar materials capable of eliminating or minimizing leakages may be used for this purpose. Under certain circumstances, and depending on the type of formation and the nature of the leaching process, the addition of a cavern-roof-protecting blanket material may not be needed. For example, under certain conditions small amounts of gases or other hydrocarbons naturally present in the formation may accumulate near the top of the cavern being leached and provide a protective seal that eliminates or minimizes leakages. In such cases, the external addition of a blanket material may be dispensed with. Also in such cases, the use of hanging string brine pipe 106 may be dispensed with if brine 105 is returned through casing 104.

The positions of the hanging pipe strings in the well are controlled so as to maintain the bottom of brine pipe 106 slightly below the top of the newly formed salt cavern. As soon as the leaching action of the solution mine water has formed a predetermined volume of space in the lower section of salt cavern 107, the positions of the hanging pipe strings in the well are adjusted so as to raise the bottom of mine water pipe 103 away from the lower section of salt cavern 107 a distance sufficient to clear and be placed above said predetermined volume of space, and solid waste 108 is then injected through mine water pipe 103 into salt cavern 107 in sufficient amounts to substantially fill such predetermined volume of space. This is illustrated in the Third Stage diagram of FIG. 1, where solid waste 108 is injected through mine water pipe 103 into the constant flow of and along with seawater 102. Solid waste 108 then exits the bottom of mine water pipe 103 along with seawater 102 and is deposited in the lower section of salt cavern 107. Solid waste 108 may be any of a number of industrial solid wastes, including oil field and refinery bottom sediments, oil field waste cuttings, uranium and other mine tailings, organic wastes, industrial pipe scale, industrial tank and pit bottoms, filter cake residues, sanitary landfills and other similar solid wastes, whether toxic or non-toxic, radioactive or non-radioactive. Such solid wastes may be injected into the constant flow of seawater 102 in dry form or in slurry form. Once the bottom section of salt cavern 107 has been substantially filled with waste 108, the hanging strings in the well are again adjusted so as to raise the bottom of mine water pipe 103 further away from the lower section of salt cavern 107 a distance sufficient to clear and be placed above said deposited amount of waste. Mine water 102 continues to be injected through mine water pipe 103 to further leach salt from the walls of salt cavern 107 and provide additional cavern volume at the lower portion of salt cavern 107, as shown in the Fourth Stage diagram of FIG. 1. The positions of the hanging strings in the well are once again adjusted so as to raise the bottom of mine water pipe 103 further away from the lower section of salt cavern 107 as solid waste 108 continues to be injected through mine water pipe 103 in sufficient amounts to substantially fill the newly created volume of space in salt cavern 107. The waste is allowed to deposit above the previously injected waste amounts. This operation is depicted in the Fifth Stage diagram of FIG. 1. The process is repeated in this fashion, continuously injecting solution mine water and solid waste through pipe 103 while maintaining the bottom of brine pipe 106 slightly below the top of the salt cavern and periodically raising the bottom of pipe 103 to accommodate additional quantities of waste until salt cavern 107 reaches a predetermined size or is substantially filled with waste. Brine 105 continues to be bled from the system through brine pipe 106 and properly disposed of as already described.

If desired, the intake of brine pipe 106 in the initial drilling stage may be lowered above the bottom of pipe 103 and positioned much closer to the bottom of pipe 103 than as shown in the First Stage and Second Stage of FIG. 1 so as to accelerate the rate of horizontal leaching of the lower section of salt cavern 107. This causes a faster development of a more horizontally elongated bottom space in the cavern (extending roughly from the area under the bottom of mine water pipe 103 to the area near the bottom of brine pipe 106) and allows for the quick formation of salt cavern space that is available much sooner for waste disposal after the well is first drilled. The waste injection may begin right after this initial creation of the lower section of salt cavern 107 in accelerated fashion. The bottom of mine water pipe 103 and the bottom of brine pipe 106 may then be raised so as to cause additional leaching of salt and the development of more cavern space above the initially leached lower section of salt cavern 107.

As depicted in the illustration of FIG. 1, the injection of solid waste 108 may be carried out in continuous fashion with the simultaneous injection of mine water by beginning the injection of the waste as soon after the initial cavern volume is formed, and continuing to inject waste while at the same time injecting solution mine water into the formation. Such continuous injection of waste may be effected by pumping waste into the constant mine water flow going into the formation, e.g., by combining measured volumes of the solid waste with mine water to form a slurry and injecting the slurry into the formation, or by injecting dry solid waste, or a slurry of the solid waste, through a separate pipe which may or may not be contained within the same strings of pipes used for injecting the mine water, all while continuing to inject mine water to leach additional amounts of salt and enlarge the cavern.

Alternatively, the injection of solid waste 108 into salt cavern 107 may be carried out in intermittent fashion by first drilling a well and developing the cavern in the manner described above and depicted in the First Stage and Second Stage diagrams of FIG. 1, and then discontinuing the flow of seawater 102 into the formation and injecting the waste through mine water pipe 103 in sufficient amounts to substantially fill a predetermined volume of space in salt cavern 107. In this mode of operation, the solid waste exits the bottom of mine water pipe 103 and is deposited in the lower section of salt cavern 107. Once the bottom section of salt cavern 107 has been substantially filled with the waste, the hanging strings in the well are again adjusted so as to raise the bottom of mine water pipe 103 further away from the lower section of salt cavern 107 a distance sufficient to clear and be placed above said deposited amount of waste. Mine water is then injected again through mine water pipe 103 to further leach salt from the walls of salt cavern 107 and provide additional cavern volume at the lower portion of salt cavern 107. The positions of the hanging strings in the well are once again adjusted so as to raise the bottom of mine water pipe 103 further away from the lower section of salt cavern 107. Solid waste is subsequently injected through mine water pipe 103 in sufficient amounts to substantially fill the newly created volume of space in salt cavern 107. The waste is allowed to deposit above the previously injected waste amounts. The process is repeated in this fashion, intermittently injecting solution mine water and solid waste through pipe 103 while maintaining the bottom of brine pipe 106 slightly below the top of the salt cavern and periodically raising the bottom of pipe 103 to accommodate additional quantities of waste until salt cavern 107 reaches a predetermined size or is substantially filled with waste. Brine 105 is bled from the system through brine pipe 106 and properly disposed of as already described.

Regardless of the particular mode of waste injection chosen, the proportions and the rates of waste and mine water injected into the well are monitored, regulated and controlled so that the enlargement and development of the salt cavern proceed simultaneously with the waste disposal at a rate that allows the cavern to reach its intended size while the waste being disposed of is injected into and collected in the cavern.

The method of this invention may be employed in the disposal of liquid wastes as well as solid wastes. When disposing of liquid wastes that are heavier than the mining fluid used to carry out the solution mining, such as, for example, certain acid sludges, copper sulfate wastes, iron sulfate-containing acids and heavy metal hydroxides, the technique illustrated in FIG. 1 and the alternative intermittent mode of operation discussed above may be employed to simultaneously develop the salt cavern and dispose of the waste in the cavern. If the liquid waste to be disposed of is lighter than the mining fluid used to carry out the solution mining, or if a solid waste (such as rubber cuttings), a gaseous waste or any material to be deposited in the cavern is lighter than the mining fluid used to carry out the solution mining, then a slightly different embodiment of the method of the present invention is preferred. Such embodiment is depicted in FIG. 2, where the method of this invention is illustrated in time sequence fashion with reference to the creation and development of a subterranean salt cavern and the simultaneous disposal of a lighter-than-water liquid waste such as, for example, certain halogenated hydrocarbons, wastes that contain benzene, toluene and/or xylene (also know as "BTX wastes"), certain oil-containing wastes and any of a number of other similar light-weight waste materials from industrial and other processes.

Figure 2:
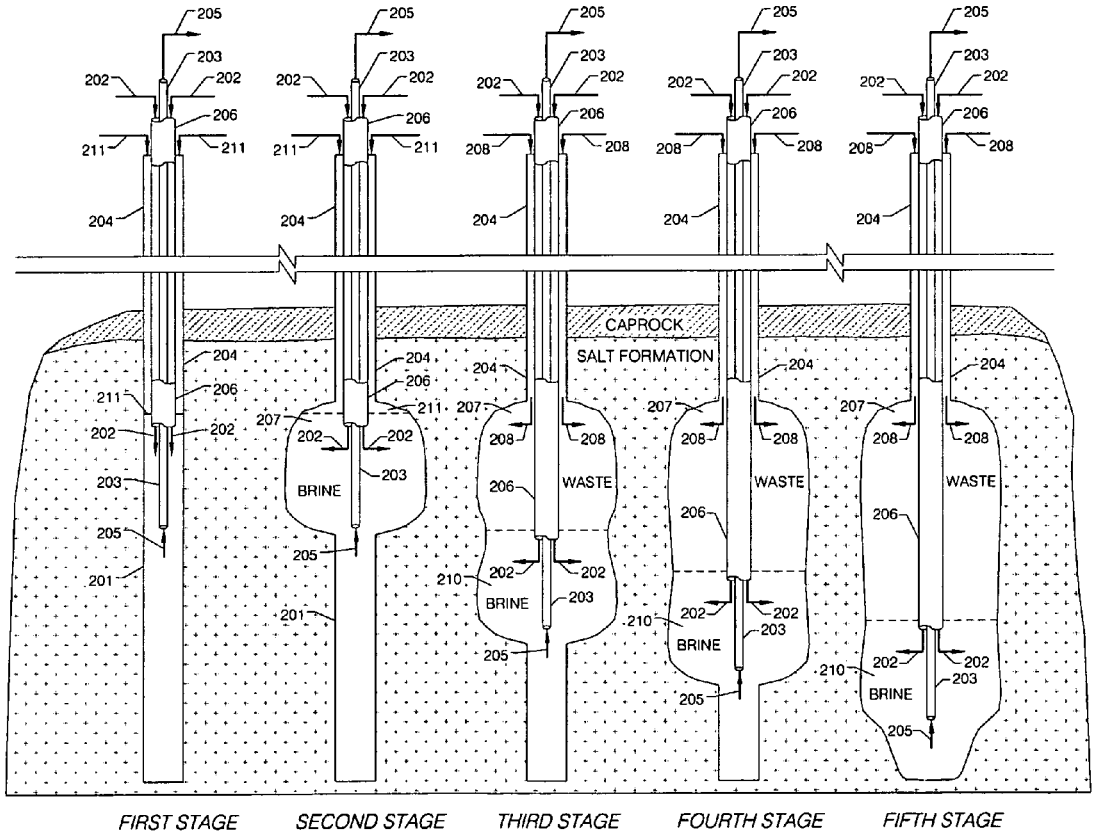
FIG. 2 is a schematic diagram of another preferred embodiment of the invention illustrating another manner in which the method of the invention is capable of simultaneously developing a subterranean salt cavern and disposing of a liquid waste that is lighter than the fluid employed to carry out the solution mining (e.g., brine or water) in the cavern.

Referring to FIG. 2, a well 201 is first drilled by conventional well drilling techniques into a naturally occurring salt formation located, typically, between about 500 and 3,000 feet below the surface of the earth. The initial drilling of the well is depicted in the First Stage diagram of FIG. 2, where well 201 is shown equipped with casing 204, which contains hanging mining pipe strings. Seawater 202 is injected through pipe 206, set inside casing 204 as part of the hanging pipe strings, and used to leach the salt in the salt formation. The leaching of the salt results in the extraction of brine 205, which exits through brine pipe 203, and contains anywhere between about 6 and 26% sodium chloride. Alternatively, fresh water may be used instead of seawater for the leaching. A cavern-roof-protecting blanket material 211, fed through casing 204, is placed and maintained in the top portion of the well; and the positions of the hanging strings in the well are made to be adjustable. As depicted in this First Stage diagram, the hanging strings are initially positioned to allow the development of a roughly symmetrically elongated salt cavern extending roughly from the area under the bottom of mine water pipe 206 to the area near the bottom of brine pipe 203. Such development is illustrated in the Second Stage diagram of FIG. 2, where salt cavern 207 begins to be formed by the leaching action of water 202, injected through mine water pipe 206, inside casing 204. Brine 205 is bled through brine pipe 203 and properly disposed of. The cavern-roof-protecting blanket material 211, fed through casing 204, is maintained in the top portion of the cavern in order to eliminate or minimize leakages as described above. The positions of the hanging strings in the well are controlled so as to maintain the bottom of mine water pipe 206 slightly below the top of the newly formed salt cavern. As soon as the leaching action of the solution mine water has formed a predetermined volume of space in salt cavern 207, the positions of the hanging strings in the well are adjusted so as to lower the bottoms of brine pipe 203 and mine water pipe 206 a distance sufficient to permit the subsequent formation of an additional predetermined volume of cavern space 210 by solution mining with mine water 202. Lighter-than-water liquid waste 208 is then injected through casing 204 into the cavern in sufficient amounts to substantially fill the volume of space above brine-occupied cavern space 210 resulting from the enlargement of salt cavern 207. This is illustrated in the Third Stage diagram of FIG. 2, where lighter-than-water liquid waste 208, injected through casing 204, displaces cavern-roof-protecting blanket material 211, exits the bottom of casing 204 inside salt cavern 207 and is deposited above the brine in the cavern. (Alternatively, lighter-than-water liquid waste 208 may be injected through mine water pipe 206, along with mine water 202, instead of through casing 204.) Once the lower section 210 of salt cavern 207 has been enlarged to a predetermined volume, the hanging strings in the well are again adjusted so as to further lower the bottom of mine water pipe 206 a distance sufficient to clear and be placed below said volume of space and further lower the bottom of brine pipe 203 further away from the bottom of mine water pipe 206 a distance sufficient to permit the subsequent formation of another predetermined volume of cavern space by solution mining with mine water 202. All the while, lighter-than-water liquid waste 208 is being injected through casing 204 and deposited in the upper section of cavern 207. Mine water 202 continues to be injected through mine water pipe 206 to further leach salt from the walls of salt cavern 207 and expand the volume of cavern space 210 at the lower portion of salt cavern 207 while continuing to inject waste, as shown in the Fourth Stage diagram of FIG. 2. The positions of the hanging strings in the well are once again adjusted so as to further lower the bottom of brine pipe 203 and the bottom of mine water pipe 206. Lighter-than-water waste 208 continues to be injected through casing 204 into salt cavern 207 in sufficient amounts to substantially fill the further expanded volume of cavern space above brine-occupied cavern space 210 in further enlarged and developed salt cavern 207 as the waste is allowed to deposit above the previously injected amounts of waste. This operation is depicted in the Fifth Stage diagram of FIG. 2. The process is repeated in this fashion, continuously injecting solution mine water and lighter-than-water liquid waste through pipe 206 and casing 204, respectively, while maintaining the bottom of brine pipe 203 slightly below the top of the salt cavern and periodically lowering the bottom of pipe 206 to accommodate additional quantities of waste until salt cavern 207 is substantially filled with waste. As mine water 202 and liquid waste 208 are injected into the cavern, brine 205 continues to be bled from the system through brine pipe 203 and properly disposed of.

As in the case of the heavier-than-water solid waste disposal illustrated in FIG. 1, the injection of the lighter-than-water liquid waste 208 may be carried out, as shown in FIG. 2, in continuous fashion by beginning the injection of the lighter-than-water liquid waste as soon after the initial cavern volume is formed and continuing to inject waste while at the same time injecting solution mine water into the formation and periodically lowering mine water pipe 206 and brine pipe 203 to accommodate additional quantities of waste and brine until salt cavern 207 is substantially filled with waste. Such continuous injection of lighter-than-water liquid waste may be effected by pumping the waste into the casing, as just described, or by pumping the waste into the constant mine water flow going into the formation, e.g., by combining measured volumes of the liquid waste with mine water to form a mixture of the two and injecting the mixture into the formation, or by injecting the liquid waste through a separate pipe which may or may not be contained within the same string of pipes used for injecting the mine water, all while continuing to inject mine water to leach additional amounts of salt and enlarge the cavern.

Also like the case of heavier-than-water solid waste disposal, the injection of lighter-than-water liquid waste 208 into salt cavern 207 may be carried out, alternatively, in intermittent fashion by first drilling a well and developing the cavern in the manner described above and depicted in the First Stage and Second Stage diagrams of FIG. 2, and then discontinuing the flow of seawater 202 into the formation and injecting the waste through casing 204 (or, alternatively, through mine water pipe 206) in sufficient amounts to substantially fill a predetermined volume of space in salt cavern 207. In this mode of operation, lighter-than-water liquid waste 208 exits the bottom of casing 204 (or, alternatively, the bottom of mine water pipe 206) and is deposited in the upper section of salt cavern 207. Once the upper section of salt cavern 207 has been substantially filled with waste 208, the hanging strings in the well are again adjusted so as to lower the bottom of brine pipe 203 and the bottom of mine water pipe 206 further into the formation a distance sufficient to clear and be placed below the already deposited amount of waste. Mine water 202 is then injected again through mine water pipe 206 to further leach salt from the walls of salt cavern 207 and provide additional cavern volume at the lower portion of salt cavern 207. Again, the process is repeated in this fashion, intermittently injecting solution mine water and waste while maintaining the bottom of mine water pipe 206 slightly below the bottom of liquid waste 208 and periodically lowering the bottoms of pipe 203 and pipe 206 to accommodate additional quantities of waste until salt cavern 207 reaches a predetermined size or is substantially filled with waste. Brine 205 is bled from the system through brine pipe 203 and properly disposed of as already described.

Figure 3:
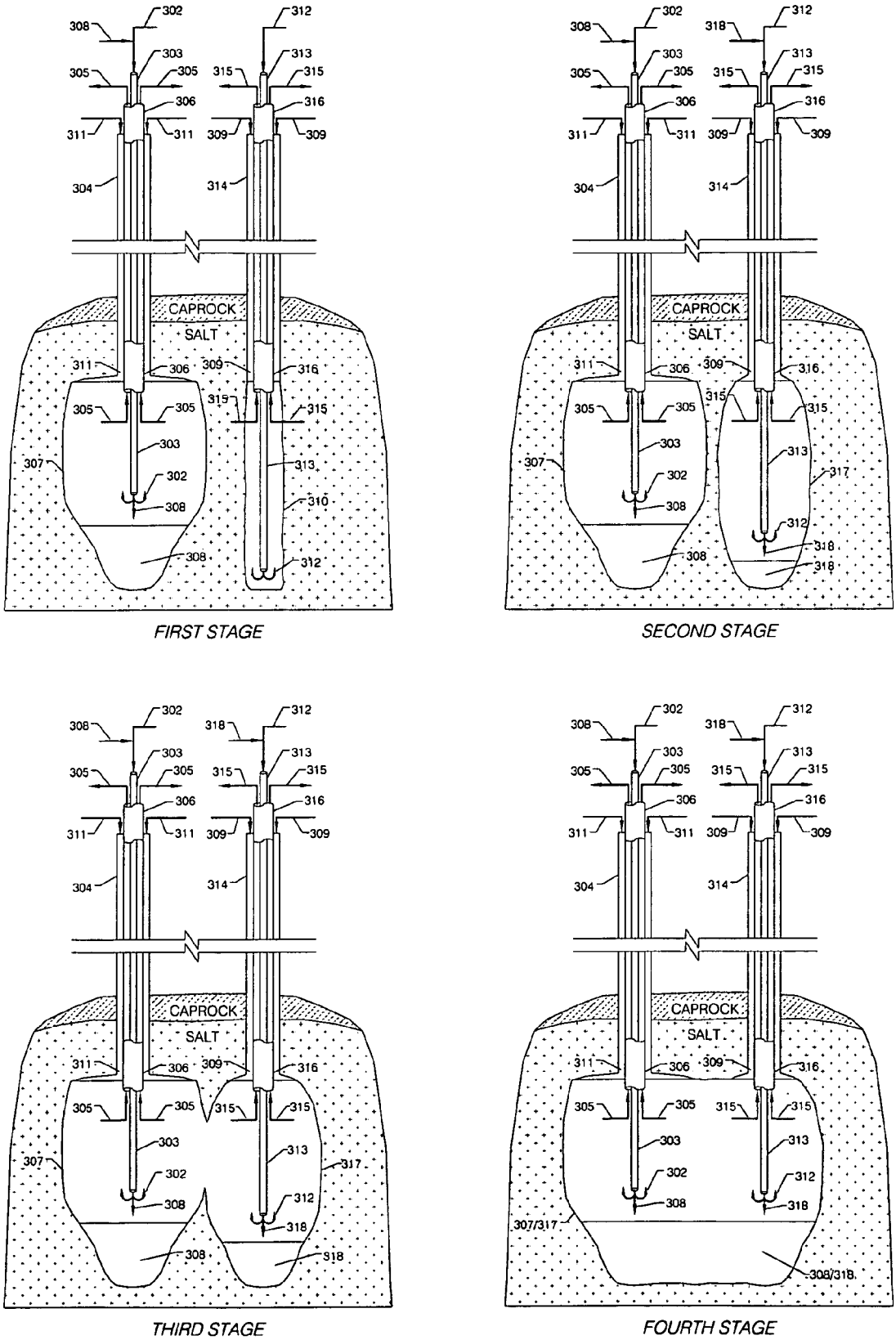
FIG. 3 is a schematic diagram of the technique for drilling an additional well and creating an additional cavern which is subsequently made to merge with a previously existing subterranean salt cavern.

FIG. 3 illustrates a feature of the invention whereby an existing cavern that has been simultaneously developed and filled with materials by one of the techniques provided by the method of the invention may be made to merge with an additional cavern also simultaneously developed and filled by the method of the invention, thereby substantially increasing the volume available for material deposition in one single cavern. As depicted in the illustration of FIG. 3 in time sequence fashion, existing subterranean salt cavern 307 has been created using the technique described above in reference to the embodiment shown in FIG. 1, i.e.. by drilling a well equipped with casing 304, which contains hanging mining pipe strings, and injecting seawater 302 through pipe 303 set inside casing 304 and using the seawater to leach the salt formation. The resulting brine 305 exits through brine pipe 306. A cavern-roof-protecting blanket material 311, fed through casing 304, has been placed and maintained on top of the well. The bottom of brine pipe 306 has been kept slightly below the top of cavern 307. Solid waste 308 has been injected through mine water pipe 303 in sufficient amounts and in the cavern development time sequence fashion depicted in FIG. 1 to substantially fill the created volume of space and accumulate at the bottom of cavern 307. The existing subterranean cavern may also be a cavern created by conventional mining techniques. The additional cavern is created by first drilling a well 310 into the same underground salt formation in the general vicinity and in the direction of previously created cavern 307. Well 310 is positioned close enough to subterranean cavern 307 so that its proximity to cavern 307 makes it feasible to merge the additional cavern with cavern 307. The technique for drilling well 310 is similar to that described in reference to drilling well 101 and creating cavern 107 in the system of FIG. 1. Thus, as depicted in the First Stage diagram of FIG. 3, well 310 is equipped with casing 314 which contains hanging mining pipe strings and where seawater 312 is injected through pipe 313, set inside casing 314, and used to leach the salt in the formation. Cavern-roof-protecting blanket material 309 is fed through casing 314 and placed and maintained in the top of the well. Brine 315 exits through brine pipe 316. The hanging pipe strings are initially positioned to allow the development of a vertically elongated salt cavern extending from the area under the bottom of mine water pipe 313 to the area near the bottom of brine pipe 316. This is done by controlling the positions of the hanging pipe strings so as to maintain the bottom of brine pipe 316 slightly below the top of the incipient new cavern. As soon as the leaching action of the solution mine water has formed a predetermined volume of space in the lower section of the new cavern, the positions of the hanging pipe strings in the well are adjusted so as to raise the bottom of mine water pipe 313 away from the lower section of the new cavern a distance sufficient to clear and be placed above the predetermined volume of space; and solid waste 318 is then injected through water pipe 313 into the constant flow of and along with water 312. This is illustrated in the Second Stage diagram of FIG. 3, where additional new salt cavern 317 begins to be formed as a result of the leaching action of mine water 312 injected through mine water pipe 313. Solid waste 318 then exits the bottom of mine water pipe 313 alone with water 312 and is deposited in the lower section of additional salt cavern 317. Once the bottom section of salt cavern 317 has been substantially filled with waste 318, the hanging strings in the well are again adjusted so as to raise the bottom of mine water pipe 313 further away from the lower section of salt cavern 317 a distance sufficient to clear and be placed above said deposited amount of waste. Mine water 312 continues to be injected through mine water pipe 313 to further leach salt from the walls of salt cavern 317 and provide additional cavern volume at the lower portion of salt cavern 317, and brine 315 continues to exit through brine pipe 316. Additional cavern 317 is made to merge with existing cavern 307 by continuing the circulation of the water through the additional well so as to leach additional salt and form additional brine while removing brine from the newly created cavern and continuing to deposit waste. The merger of the two caverns is depicted in the Third Stage diagram of FIG. 3, where solid waste 318 continues to exit the bottom of mine water pipe 313 along with water 312 and is deposited in the lower section of additional salt cavern 317. The positions of the hanging strings in the well are once again adjusted so as to raise the bottom of mine water pipe 313 further away from the lower section of salt cavern 317 as solid waste 318 continues to be injected through mine water pipe 313 in sufficient amounts to substantially fill the newly created volume of space in salt cavern 317. The waste is allowed to deposit above the previously injected waste amounts. Brine 315 continues to be bled through brine pipe 316 and properly disposed of as already described. The process is repeated in this fashion, continuously injecting solution mine water and solid waste through pipe 313 while maintaining the bottom of brine pipe 316 slightly below the top of the salt cavern, and periodically raising the bottom of pipe 313 to accommodate additional quantities of waste until additional salt cavern 317 and initial salt cavern 307 become one single cavern. This is illustrated in the Fourth Stage diagram of FIG. 3, where the additional salt cavern and the initially created salt cavern are now shown as single waste disposal cavern 307/317, and where the continued injection and disposal of additional quantities of waste that take place simultaneously with the formation of cavern 307/317 result in the accumulation of substantial amounts of the injected wastes, now shown as deposited solid waste 308/318 inside and at the lower portion of the cavern. After the merger of the two caverns takes place the casing, hanging mining pipe strings and other equipment used in creating subterranean cavern 307 and additional new salt cavern 317 may be left in place, as shown on FIG. 3, and continued to be operated as already described. Alternatively, one of the two wells may be plunged and abandoned while continuing to simultaneously enlarge the merged single waste disposal cavern by the method of this invention using the other well or, if convenient, depending on process requirements and equipment availability, one of the wells may be used only to feed the waste while the other well is operated to withdraw the brine.

Regardless of the particular mode of waste injection chosen, the proportions and the rates of liquid waste and mine water injected into the well are monitored, regulated and controlled so that the enlargement of the salt cavern proceeds simultaneously with the liquid waste disposal at a rate that allows the cavern to reach its intended size while the waste being disposed of is injected into and collected in the salt cavern.

By repositioning the hanging strings, liquids collected in the top of the cavern, and at times in the bottom of the cavern, can be withdrawn if for any reason they are needed for reuse or recycling. The brine that is removed from the cavern during solution mining may carry with it small amounts of undesirable waste particles and/or other contaminants. It is desirable, in such cases, to process the brine as it exits the system in order to remove from it such small amounts of undesirable waste particles and/or other contaminants. Such processing may take the form of one or more chemical treatments, such as pH adjustments and the like, or filtration, settling, ion exchange and/or other contaminant separation techniques.

The method of this invention may also be employed to deposit materials other than waste in salt caverns while simultaneously continuing the development of the caverns. The combination of the two operations in one and the accelerated feature of the resulting process allow the placement of such materials in caverns, for whatever purposes, to be conducted in a cost-effective manner and with minimal impact on the environment. If such non-waste materials are heavier than the fluid employed to carry out the solution mining, then a scheme such as that described above in connection with the technique illustrated in FIG. 1 may be used to place the materials in the caverns. If the materials are lighter than the fluid employed to carry out the solution mining, then a scheme such as that described in connection with the technique illustrated in FIG. 2 may be conveniently used.

While the present invention has been described in terms of particular embodiments and applications, in both summarized and detailed forms, it is not intended that these descriptions in any way limit its scope to any such embodiments and applications, and it will be understood that many substitutions, changes and variations in the described embodiments, applications and details of the method illustrated herein and in the appended claims can be made by those skilled in the art without departing from the spirit of this invention.

We claim:

1. A method for the simultaneous development of an underground cavern and deposition of a material, said method comprising:

(a) drilling a well into an underground salt formation;

(b) setting a casing and hanging pipe strings positioned at designated locations inside the well and adjustable with respect to the vertical dimensions of the well;

(c) solution mining the salt formation by injecting water through a first pipe set inside said casing and circulating said water through the well so as to leach salt and form brine;

(d) injecting a cavern-roof-protecting blanket material through said casing and maintaining it on top of the cavern;

(e) creating a cavern inside the salt formation by (i) continuing the circulation of said water through the well so as to leach additional salt and form additional brine; (ii) removing brine from said created cavern through a second pipe set inside said casing; and (iii) maintaining said cavern-roof-protecting blanket material on top of said created cavern, until a predetermined initial cavern volume is reached;

(f) thereafter injecting an initial quantity of said material into said created cavern, said initial quantity of injected material being sufficient to substantially fill said predetermined initial cavern volume, and depositing said initial quantity of said material in said created cavern, said initial quantity of material injection taking place simultaneously with the development of said cavern inside the salt formation;

(g) continuing the circulation of water through the well so as to leach additional salt and form additional brine while removing additional brine from said created cavern through said second pipe set inside said casing, until a predetermined additional cavern volume is reached;

(h) injecting additional quantities of said material into said created cavern, said additional quantities of injected material being sufficient to substantially fill said predetermined additional cavern volume, and depositing said additional quantities of material in said created cavern, said hanging pipe strings inside the well so positioned within the well and cavern as to allow the injection of said additional quantities of material into the cavern and the timely removal of the brine that carries the dissolved salt out of the cavern without carrying over any substantial amounts of the deposited material, said injection of additional quantities of material taking place simultaneously with the development of said cavern inside the salt formation while monitoring and regulating the proportions and rates of material and solution mining water injected into the well so that cavern development takes place at a rate sufficient to allow the cavern to reach a prescribed size while the material is injected and deposited into the cavern; and (i) successively repeating steps (g) and (h) until a desired final cavern volume is reached and utilizing the entirety of said desired final cavern volume for depositing said material.

2. The method of claim 1, wherein said injection of said initial quantity of material and said injection of said additional quantities of material into said created cavern are carried out continuously.

3. The method of claim 1, wherein said injection of said initial quantity of material and said injection of said additional quantities of material into said created cavern are carried out intermittently at time intervals between individual successive injections of solution mining water.

4. The method of claim 1, wherein the configuration of the hanging pipe strings is arranged in concentric fashion so that said first pipe is a centric pipe and the brine is removed through the annulus formed by said second pipe surrounding said centric first pipe through which the water used to solution mine the underground salt formation is injected.

5. The method of claim 1, wherein the configuration of the hanging pipe strings is arranged in concentric fashion so that said second pipe is a centric pipe and the water used to solution mine the salt formation is injected through the annulus formed by said first pipe surrounding said centric second pipe through which the brine is removed.

6. The method of claim 1, wherein said water used for solution mining the salt formation is seawater.

7. The method of claim 1, wherein said material injected into said created cavern is a waste.

8. The method of claim 1, wherein two or more wells are drilled into said underground salt formation, provided with said casings and hanging pipe strings positioned at designated locations, and operated to solution mine and create said cavern inside the salt formation.

9. The method of claim 1, further comprising (i) drilling at least one additional well into said underground salt formation in the direction of said created cavern; (ii) setting at least one additional casing and hanging pipe strings positioned at designated locations inside said additional well; (iii) solution mining the salt formation by injecting water through at least one additional first pipe set inside said additional casing and circulating said water through said additional well so as to leach salt and form brine, thereby creating at least one additional cavern; (iv) continuing the circulation of said water through said additional well so as to leach additional salt and form additional brine while removing brine from said created additional cavern through at least one additional second pipe set inside said additional casing until said created cavern and said created additional cavern merge with each other to form a single material deposit cavern inside the salt formation; and (v) continuing the injection and deposition of additional quantities of said material into said single material deposit cavern, said continued injection and deposition of additional quantities of material taking place simultaneously with the formation of said single material deposit cavern.

10. The method of claim 1, further comprising processing at least a portion of said removed brine so as to remove from it small quantities of contaminants that may be carried with said brine as it is removed from said salt formation.

11. A method for the simultaneous development of an underground cavern and deposition of multiple materials, said method comprising:

(a) drilling a well into an underground salt formation;

(b) setting a casing and hanging pipe strings positioned at designated locations inside the well;

(c) solution mining the salt formation by injecting water through a first pipe set inside said casing and circulating said water through the well so as to leach salt and form brine;

(d) injecting a cavern-roof-protecting blanket material through said casing and maintaining it on top of the cavern;

(e) creating a cavern inside the salt formation by (i) continuing the circulation of said water through the well so as to leach additional salt and form additional brine; (ii) removing brine from said created cavern through a second pipe set inside said casing; and (iii) maintaining said cavern-roof-protecting blanket material on top of said created cavern, until a predetermined initial cavern volume is reached;

(f) thereafter injecting an initial quantity of a heavier-than-brine material into said created cavern through said first pipe set inside said casing and depositing said initial quantity of said heavier-than-brine material in the lower portion of said created cavern, said initial quantity of heavier-than-brine material injection taking place simultaneously with the development of said cavern inside the salt formation;

(g) thereafter injecting an initial quantity of a lighter-than-brine material into said created cavern through said casing or through said first pipe set inside said casing and depositing said initial quantity of said lighter-than-brine material in the upper portion of said created cavern, said initial quantity of lighter-than-brine material injection taking place simultaneously with the development of said cavern inside the salt formation;

(h) continuing the circulation of water through the well so as to leach additional salt and form additional brine while removing additional brine from said created cavern through said second pipe set inside said casing, until a predetermined additional cavern volume is reached;

(i) injecting additional quantities of said heavier-than-brine material into said created cavern through said first pipe set inside said casing and depositing said additional quantities of heavier-than-brine material in the lower portion of said created cavern, said additional quantities of heavier-than-brine material injection taking place simultaneously with the development of said cavern inside the salt formation; and (j) injecting additional quantities of said lighter-than-brine material into said created cavern through said casing or through said first pipe set inside said casing and depositing said additional quantities of said lighter-than-brine material in the upper portion of said created cavern, said additional quantities of said lighter-than-brine material injection taking place simultaneously with the development of said cavern inside the salt formation.

12. The method of claim 11, wherein said injections of said heavier-than-brine material and said injections of said lighter-than-brine material into said created cavern are carried out continuously, and the proportions and rates of materials and solution mining water injected into the well are monitored and regulated so that cavern development takes place at a rate sufficient to allow the cavern to reach a prescribed size while the materials are injected and deposited into the cavern.

13. The method of claim 11, wherein said injections of said heavier-than-brine brine material and said injections of said lighter-than-brine material into said created cavern are carried out intermittently at time intervals between individual successive injections of solution mining water, and the proportions and rates of materials and solution mining water injected into the well are monitored and regulated so that cavern development takes place at a rate sufficient to allow the cavern to reach a prescribed size while the materials are injected and deposited into the cavern.

14. The method of claim 11, wherein said hanging pipe strings inside the well are adjustable with respect to the vertical dimensions of the well and so positioned within the well and cavern as to allow the injection of said additional quantities of materials into the cavern and the timely removal of the brine that carries the dissolved salt out of the cavern without carrying over any substantial amounts of the deposited materials.

15. The method of claim 11, further comprising successively repeating steps (h), (i) and (j) until a desired final cavern volume is reached and utilizing the entirety of said desired final cavern volume for depositing said materials.

16. The method of claim 11, wherein said water used for solution mining the salt formation is seawater.

17. The method of claim 11, wherein said materials injected into said created cavern are wastes.

18. The method of claim 11, wherein two or more wells are drilled into said underground salt formation, provided with said casings and hanging pipe strings positioned at designated locations, and operated to solution mine and create said cavern inside the salt formation.

19. The method of claim 11, further comprising (i) drilling at least one additional well into said underground salt formation in the direction of said created cavern; (ii) setting at least one additional casing and hanging pipe strings positioned at designated locations inside said additional well; (iii) solution mining the salt formation by injecting water through at least one additional first pipe set inside said additional casing and circulating said water through said additional well so as to leach salt and form brine, thereby creating at least one additional cavern; (iv) continuing the circulation of said water through said additional well so as to leach additional salt and form additional brine while removing brine from said created additional cavern through at least one additional second pipe set inside said additional casing until said created cavern and said created additional cavern merge with each other to form a single material deposit cavern inside the salt formation; and (v) continuing the injection and deposition of additional quantities of said materials into said single material deposit cavern, said continued injection and deposition of additional quantities of materials taking place simultaneously with the formation of said single material deposit cavern.

20. The method of claim 11, further comprising processing said removed brine so as to remove from it small quantities of contaminants that may be carried with said brine as it is removed from said salt formation.

21. A method for the simultaneous enlargement and development of an existing underground cavern and deposition of a material, said method comprising:

(a) drilling a well into the underground salt formation where said cavern exists so as to penetrate said cavern;

(b) setting a casing and hanging pipe strings positioned at designated locations inside the well and adjustable with respect to the vertical dimensions of the well;

(c) injecting an initial quantity of said material into said existing underground cavern, said initial quantity of injected material being sufficient to substantially fill a predetermined initial cavern volume within said existing underground cavern, and depositing said initial quantity of said material in said existing cavern;

(d) solution mining the existing cavern by injecting water through a first pipe set inside said casing and circulating said water through the well so as to leach salt and form brine;

(e) removing brine from said existing cavern through a second pipe set inside said casing;

(f) continuing the circulation of water through the well so as to leach additional salt, form additional brine and enlarge said existing cavern while removing additional brine from said enlarged cavern through said second pipe set inside said casing, until a predetermined additional cavern volume is reached;

(g) injecting additional quantities of said material into said enlarged cavern, said additional quantities of injected material being sufficient to substantially fill said predetermined additional cavern volume, and depositing said additional quantities of material in said enlarged cavern, said hanging pipe strings inside the well so positioned within the well and cavern as to allow the injection of said additional quantities of material into the enlarged cavern and the timely removal of the brine that carries the dissolved salt out of the cavern without carrying over any substantial amounts of the deposited material, said additional quantities of material injection taking place simultaneously with the enlargement and development of said existing cavern while monitoring and regulating the proportions and rates of material and solution mining water injected into the well so that cavern development takes place at a rate sufficient to allow the enlarged cavern to reach a prescribed size while the material is injected and deposited into the cavern; and (h) successively repeating steps (f) and (g) until a desired final cavern volume is reached and utilizing the entirety of said desired final cavern volume for depositing said material.

22. The method of claim 21, wherein said injection of said initial quantity of material and said injection of said additional quantities of material into said cavern are carried out continuously.

23. The method of claim 21, wherein said injection of said initial quantity of material and said injection of said additional quantities of material into said cavern are carried out intermittently at time intervals between individual successive injections of solution mining water.

24. The method of claim 21, wherein said water used for solution mining the existing cavern is seawater.

25. The method of claim 21, wherein said material injected into said existing underground cavern and said enlarged cavern is a waste.

26. The method of claim 21, wherein two or more wells are drilled into said underground salt formation where said cavern exists so as to penetrate said existing cavern, provided with said casings and hanging pipe strings positioned at designated locations, and operated to solution mine and enlarge said existing underground cavern.

27. The method of claim 21, further comprising processing at least a portion of said removed brine so as to remove from it small quantities of contaminants that may be carried with said brine as it is removed from said salt formation.

28. A method for the simultaneous development of an underground cavern and disposal of a heavier-than-brine waste, said method comprising:

(a) drilling a well into an underground salt formation;

(b) setting a casing and hanging pipe strings positioned at designated locations inside the well and adjustable with respect to the vertical dimensions of the well;

(c) solution mining the salt formation by injecting water through a first pipe set inside said casing and circulating said water through the well so as to leach salt and form brine;

(d) creating a cavern inside the salt formation by (i) continuing the circulation of said water through the well so as to leach additional salt and form additional brine; (ii) removing brine from said created cavern through a second pipe set inside said casing; and (iii) maintaining a protective seal on top of said created cavern, until a predetermined initial cavern volume is reached;

(e) thereafter injecting an initial quantity of said heavier-than-brine waste into said created cavern through said first pipe set inside said casing, said initial quantity of injected heavier-than-brine waste being sufficient to substantially fill said predetermined initial cavern volume, and disposing of said initial quantity of said waste in said created cavern, said initial quantity of waste injection taking place simultaneously with the development of said cavern inside the salt formation;

(f) continuing the circulation of water through the well so as to leach additional salt and form additional brine while removing additional brine from said created cavern through said second pipe set inside said casing, until a predetermined additional cavern volume is reached;

(g) injecting additional quantities of said heavier-than-brine waste into said created cavern through said first pipe set inside said casing, said additional quantities of injected heavier-than-brine waste being sufficient to substantially fill said predetermined additional cavern volume, and disposing of said additional quantities of waste in said created cavern, said hanging pipe strings inside the well so positioned within the well and cavern as to allow the injection of said additional quantities of waste into the cavern and the timely removal of the brine that carries the dissolved salt out of the cavern without carrying over any substantial amounts of the deposited waste, said additional quantities of waste injection taking place simultaneously with the development of said cavern inside the salt formation while monitoring and regulating the proportions and rates of waste and solution mining water injected into the well so that cavern development takes place at a rate sufficient to allow the cavern to reach a prescribed size while the waste is injected and deposited into the cavern; and (h) successively repeating steps (f) and (g) until a desired final cavern volume is reached and utilizing the entirety of said desired final cavern volume for depositing said waste.

29. The method of claim 28, wherein said injection of said initial quantity of waste and said injection of said additional quantities of waste into said created cavern through said first pipe are carried out continuously into the constant flow of the solution mining water.

30. The method of claim 28, wherein said injection of said initial quantity of waste and said injection of said additional quantities of waste into said created cavern through said first pipe are carried out intermittently at time intervals between individual successive injections of solution mining water.

31. The method of claim 28, wherein the configuration of the hanging pipe strings is arranged in concentric fashion so that said first pipe through which said water is injected is a centric pipe and the brine is removed through the annulus formed by said second pipe surrounding said centric first pipe through which said water is injected.

32. The method of claim 28, wherein said water used for solution mining the salt formation is seawater.

33. The method of claim 28, wherein said heavier-than-brine waste is a solid waste injected into said created cavern in slurry form.

34. The method of claim 28, wherein two or more wells are drilled into said underground salt formation, provided with said casings and hanging pipe strings positioned at designated locations, and operated to solution mine and create said cavern inside the salt formation.

35. The method of claim 28, further comprising (i) drilling at least one additional well into said underground salt formation in the direction of said created cavern; (ii) setting at least one additional casing and hanging pipe strings positioned at designated locations inside said additional well; (iii) solution mining the salt formation by injecting water through at least one additional first pipe set inside said additional casing and circulating said water through said additional well so as to leach salt and form brine, thereby creating at least one additional cavern; (iv) continuing the circulation of said water through said additional well so as to leach additional salt and form additional brine while removing brine from said created additional cavern through at least one additional second pipe set inside said additional casing until said created cavern and said created additional cavern merge with each other to form a single waste disposal cavern inside the salt formation; and (v) continuing the injection and disposal of additional quantities of said waste into said single waste disposal cavern, said continued injection and disposal of additional quantities of waste taking place simultaneously with the formation of said single waste disposal cavern.

36. The method of claim 28, further comprising processing at least a portion of said removed brine so as to remove from it small quantities of contaminants that may be carried with said brine as it is removed from said salt formation.

37. A method for the simultaneous development of an underground cavern and disposal of a lighter-than-brine waste, said method comprising:

(a) drilling a well into an underground salt formation;

(b) setting a casing and hanging pipe strings positioned at designated locations inside the well and adjustable with respect to the vertical dimensions of the well;

(c) solution mining the salt formation by injecting water through a first pipe set inside said casing and circulating said water through the well so as to leach salt and form brine;

(d) creating a cavern inside the salt formation by (i) continuing the circulation of said water through the well so as to leach additional salt and form additional brine; (ii) removing brine from said created cavern through a second pipe set inside said casing; and (iii) maintaining a protective seal on top of said created cavern, until a predetermined initial cavern volume is reached;

(e) thereafter injecting an initial quantity of said lighter-than-brine waste into said created cavern through said casing, said initial quantity of injected lighter-than-brine waste being sufficient to substantially fill said predetermined initial cavern volume, and disposing of said initial quantity of said waste in said created cavern, said initial quantity of waste injection taking place simultaneously with the development of said cavern inside the salt formation;

(f) continuing the circulation of water through the well so as to leach additional salt and form additional brine while removing additional brine from said created cavern through said second pipe set inside said casing, until a predetermined additional cavern volume is reached;

(g) injecting additional quantities of said lighter-than-brine waste into said created cavern through said casing, said additional quantities of injected lighter-than-brine waste being sufficient to substantially fill said predetermined additional cavern volume, and disposing of said additional quantities of waste in said created cavern, said hanging pipe strings inside the well so positioned within the well and cavern as to allow the injection of said additional quantities of waste into the cavern and the timely removal of the brine that carries the dissolved salt out of the cavern without carrying over any substantial amounts of the deposited waste, said additional quantities of waste injection taking place simultaneously with the development of said cavern inside the salt formation while monitoring and regulating the proportions and rates of waste and solution mining water injected into the well so that cavern development takes place at a rate sufficient to allow the cavern to reach a prescribed size while the waste is injected and deposited into the cavern; and (h) successively repeating steps (f) and (g) until a desired final cavern volume is reached and utilizing the entirety of said desired final cavern volume for depositing said waste.

38. The method of claim 37, wherein said injection of said initial quantity of waste and said injection of said additional quantities of waste into said created cavern through said casing are carried out continuously.

39. The method of claim 37, wherein said injection of said initial quantity of waste and said injection of said additional quantities of waste into said created cavern through said easing are carried out intermittently at time intervals between individual successive injections of solution mining water.

40. The method of claim 37, wherein the configuration of the hanging pipe strings is arranged in concentric fashion so that said second pipe is a centric pipe and the water used to solution mine the salt formation is injected through the annulus formed by said first pipe surrounding said centric second pipe through which the brine is removed.

41. The method of claim 37, wherein said water used for solution mining the salt formation is seawater.

42. The method of claim 37, wherein said lighter-than-brine waste is a fluid waste.

43. The method of claim 37, wherein two or more wells are drilled into said underground salt formation, provided with said casings and hanging pipe strings positioned at designated locations, and operated to solution mine and create said cavern inside the salt formation.

44. The method of claim 37, further comprising (i) drilling at least one additional well into said underground salt formation in the direction of said created cavern; (ii) setting at least one additional casing and hanging pipe strings positioned at designated locations inside said additional well; (iii) solution mining the salt formation by injecting water through at least one additional first pipe set inside said additional casing and circulating said water through said additional well so as to leach salt and form brine, thereby creating at least one additional cavern; (iv) continuing the circulation of said water through said additional well so as to leach additional salt and form additional brine while removing brine from said created additional cavern through at least one additional second pipe set inside said additional casing until said created cavern and said created additional cavern merge with each other to form a single waste disposal cavern inside the salt formation; and (v) continuing the injection and disposal of additional quantities of said waste into said single waste disposal cavern, said continued injection and disposal of additional quantities of waste taking place simultaneously with the formation of said single waste disposal cavern.

45. The method of claim 37, further comprising processing at least a portion of said removed brine so as to remove from it small quantities of contaminants that may be carried with said brine as it is removed from said salt formation.

46. A method for the simultaneous development of an underground cavern and deposition of multiple materials, said method comprising:

(a) drilling a well into an underground salt formation;

(b) setting a casing and hanging pipe strings positioned at designated locations inside the well;

(c) solution mining the salt formation by injecting water through a first pipe set inside said casing and circulating said water through the well so as to leach salt and form brine;

(d) injecting a cavern-roof-protecting blanket material through said casing and maintaining it on top of the cavern;

(e) creating a cavern inside the salt formation by (i) continuing the circulation of said water through the well so as to leach additional salt and form additional brine; (ii) removing brine from said created cavern through a second pipe set inside said casing; and (iii) maintaining said cavern-roof-protecting blanket material on top of said created cavern, until a predetermined initial cavern volume is reached;

(f) thereafter injecting an initial quantity of a lighter-than-brine material into said created cavern through said casing or through said first pipe set inside said casing and depositing said initial quantity of said lighter-than-brine material in the upper portion of said created cavern, said initial quantity of lighter-than-brine material injection taking place simultaneously with the development of said cavern inside the salt formation;

(g) thereafter injecting an initial quantity of a heavier-than-brine material into said created cavern through said second pipe set inside said casing and depositing said initial quantity of said heavier-than-brine material in the lower portion of said created cavern, said initial quantity of heavier-than-brine material injection taking place simultaneously with the development of said cavern inside the salt formation;

(h) continuing the circulation of water through the well so as to leach additional salt and form additional brine while removing additional brine from said created cavern through said second pipe set inside said casing, until a predetermined additional cavern volume is reached;

(i) injecting additional quantities of said lighter-than-brine material into said created cavern through said casing or through said first pipe set inside said casing and depositing said additional quantities of lighter-than-brine material in the upper portion of said created cavern, said additional quantities of lighter-than-brine material injection taking place simultaneously with the development of said cavern inside the salt formation; and (j) injecting additional quantities of said heavier-than-brine material into said created cavern through said second pipe set inside said casing and depositing said additional quantities of said heavier-than-brine material in the lower portion of said created cavern, said additional quantities of said heavier-than-brine material injection taking place simultaneously with the development of said cavern inside the salt formation.

47. The method of claim 46, wherein said injections of said heavier-than-brine material and said injections of said lighter-than-brine material into said created cavern are carried out continuously, and the proportions and rates of materials and solution mining water injected into the well are monitored and regulated so that cavern development takes place at a rate sufficient to allow the cavern to reach a prescribed size while the materials are injected and deposited into the cavern.

48. The method of claim 46, wherein said injections of said heavier-than-brine material and said injections of said lighter-than-brine material into said created cavern are carried out intermittently at time intervals between individual successive injections of solution mining water, and the proportions and rates of materials and solution mining water injected into the well are monitored and regulated so that cavern development takes place at a rate sufficient to allow the cavern to reach a prescribed size while the materials are injected and deposited into the cavern.

49. The method of claim 46, wherein said hanging pipe strings inside the well are adjustable with respect to the vertical dimensions of the well and so positioned within the well and cavern as to allow the injection of said additional quantities of materials into the cavern and the timely removal of the brine that carries the dissolved salt out of the cavern without carrying over any substantial amounts of the deposited materials.

50. The method of claim 46, further comprising successively repeating steps (h), (i) and (j) until a desired final cavern volume is reached and utilizing the entirety of said desired final cavern volume for depositing said materials.

51. The method of claim 46, wherein said water used for solution mining the salt formation is seawater.

52. The method of claim 46, wherein said materials injected into said created cavern are wastes.

53. The method of claim 46, wherein two or more wells are drilled into said underground salt formation, provided with said casings and hanging pipe strings positioned at designated locations, and operated to solution mine and create said cavern inside the salt formation.

54. The method of claim 46, further comprising (i) drilling at least one additional well into said underground salt formation in the direction of said created cavern; (ii) setting at least one additional casing and hanging pipe strings positioned at designated locations inside said additional well; (iii) solution mining the salt formation by injecting water through at least one additional first pipe set inside said additional casing and circulating said water through said additional well so as to leach salt and form brine, thereby creating at least one additional cavern; (iv) continuing the circulation of said water through said additional well so as to leach additional salt and form additional brine while removing brine from said created additional cavern through at least one additional second pipe set inside said additional casing until said created cavern and said created additional cavern merge with each other to form a single material deposit cavern inside the salt formation; and (v) continuing the injection and deposition of additional quantities of said materials into said single material deposit cavern, said continued injection and deposition of additional quantities of materials taking place simultaneously with the formation of said single material deposit cavern.

55. The method of claim 46, further comprising processing said removed brine so as to remove from it small quantities of contaminants that may be carried with said brine as it is removed from said salt formation.

* * * * *